US012479646B2

(12) United States Patent
Oliveri

(10) Patent No.: US 12,479,646 B2
(45) Date of Patent: Nov. 25, 2025

(54) ASSEMBLY DEFINING A CHAMBER FOR AN ACTIVE MATERIAL AND METHOD FOR MANUFACTURING SUCH AN ASSEMBLY

(71) Applicant: AIRNOV, INC., Wilmington, DE (US)

(72) Inventor: Cyril Oliveri, Romorantin-Lanthenay (FR)

(73) Assignee: AIRNOV, INC., New Castle, DE (US)

( * ) Notice: Subject to any disclaimer, the term of this patent is extended or adjusted under 35 U.S.C. 154(b) by 0 days.

(21) Appl. No.: 18/724,034

(22) PCT Filed: Dec. 30, 2022

(86) PCT No.: PCT/EP2022/088077
§ 371 (c)(1),
(2) Date: Jun. 25, 2024

(87) PCT Pub. No.: WO2023/126520
PCT Pub. Date: Jul. 6, 2023

(65) Prior Publication Data

US 2025/0091791 A1 Mar. 20, 2025

(30) Foreign Application Priority Data

Dec. 31, 2021 (EP) ..... 21218445

(51) Int. Cl.
*B65D 81/26* (2006.01)

(52) U.S. Cl.
CPC ..... *B65D 81/265* (2013.01); *B65D 81/266* (2013.01)

(58) Field of Classification Search
CPC .... B65D 81/266; B65D 43/162; B65D 25/04; A61J 1/03; A61B 10/0096
(Continued)

(56) References Cited

U.S. PATENT DOCUMENTS 3,135,566 A * 6/1964 Frank ..... G07D 9/004 206/0.82
4,834,234 A 5/1989 Sacherer et al.
(Continued)

FOREIGN PATENT DOCUMENTS

CN 208828407 U 5/2019
EP 2573007 A1 3/2013
(Continued)

OTHER PUBLICATIONS

International Search Report with Written Opinion of the International Searching Authority, dated May 16, 2023, with respect to International Application No. PCT/EP2022/088077.

*Primary Examiner* — Ernesto A Grano
(74) *Attorney, Agent, or Firm* — Scott R. Cox

(57) ABSTRACT

This assembly includes a tubular body and a breathable insert configured to be attached inside the tubular body to define a chamber for an active material. The tubular body includes a transverse wall and a lateral wall, and the breathable insert includes a base wall and a side wall having an open end on an opposite side from the base wall. The chamber is delimited by a bottom part of the tubular body and is closed by the breathable insert having its open end turned toward the transverse wall. The side wall of the breathable insert includes a mechanical holding portion configured to cooperate by surface interference with a corresponding mechanical holding portion of the tubular body. In an anchored configuration, a continuous peripheral seal is formed between the breathable insert and the tubular body.

21 Claims, 6 Drawing Sheets

(58) Field of Classification Search
USPC ..... 206/205
See application file for complete search history.

(56) References Cited

U.S. PATENT DOCUMENTS

| | | | | |
|---|---|---|---|---|
| 4,923,059 | A * | 5/1990 | Evers | B65D 85/10484 229/125.17 |
| 5,114,003 | A * | 5/1992 | Jackisch | B65D 81/268 206/204 |
| 5,736,616 | A | 4/1998 | Ching et al. | |
| 5,788,064 | A * | 8/1998 | Sacherer | B65D 53/00 220/849 |
| 6,571,942 | B2 * | 6/2003 | Riemenschneider | B65D 81/266 206/204 |
| 10,526,128 | B2 * | 1/2020 | Schneider | B29C 45/44 |
| 10,737,848 | B2 * | 8/2020 | Philip | B65D 51/30 |
| 10,974,887 | B2 * | 4/2021 | Freedman | B65D 81/266 |
| 11,325,771 | B2 * | 5/2022 | Freedman | B65D 53/02 |
| 2009/0120931 | A1 * | 5/2009 | Murray | B65D 51/165 53/396 |
| 2010/0140116 | A1 * | 6/2010 | Stiene | B65D 81/266 206/459.1 |
| 2011/0127176 | A1 * | 6/2011 | Chang | B65D 81/266 206/204 |
| 2012/0193246 | A1 * | 8/2012 | Chang | B65D 51/245 206/204 |
| 2013/0213828 | A1 * | 8/2013 | Chatterjee | A61J 1/03 206/204 |
| 2013/0220844 | A1 * | 8/2013 | Logel | B65D 43/162 206/204 |
| 2013/0334074 | A1 * | 12/2013 | Wada | B65D 81/266 206/204 |
| 2015/0136618 | A1 * | 5/2015 | Patel | B65D 81/22 206/0.5 |
| 2018/0016081 | A1 | 1/2018 | Schneider | |

FOREIGN PATENT DOCUMENTS

| | | | |
|---|---|---|---|
| GB | 731417 | A | 6/1955 |
| JP | 2014133577 | A | 7/2014 |
| WO | 9851758 | A1 | 11/1998 |
| WO | 9948963 | A2 | 9/1999 |
| WO | 2018149778 | A1 | 8/2018 |
| WO | 2019197165 | A1 | 10/2019 |
| WO | 2020229602 | A1 | 11/2020 |
| WO | 2021136829 | A1 | 7/2021 |

* cited by examiner

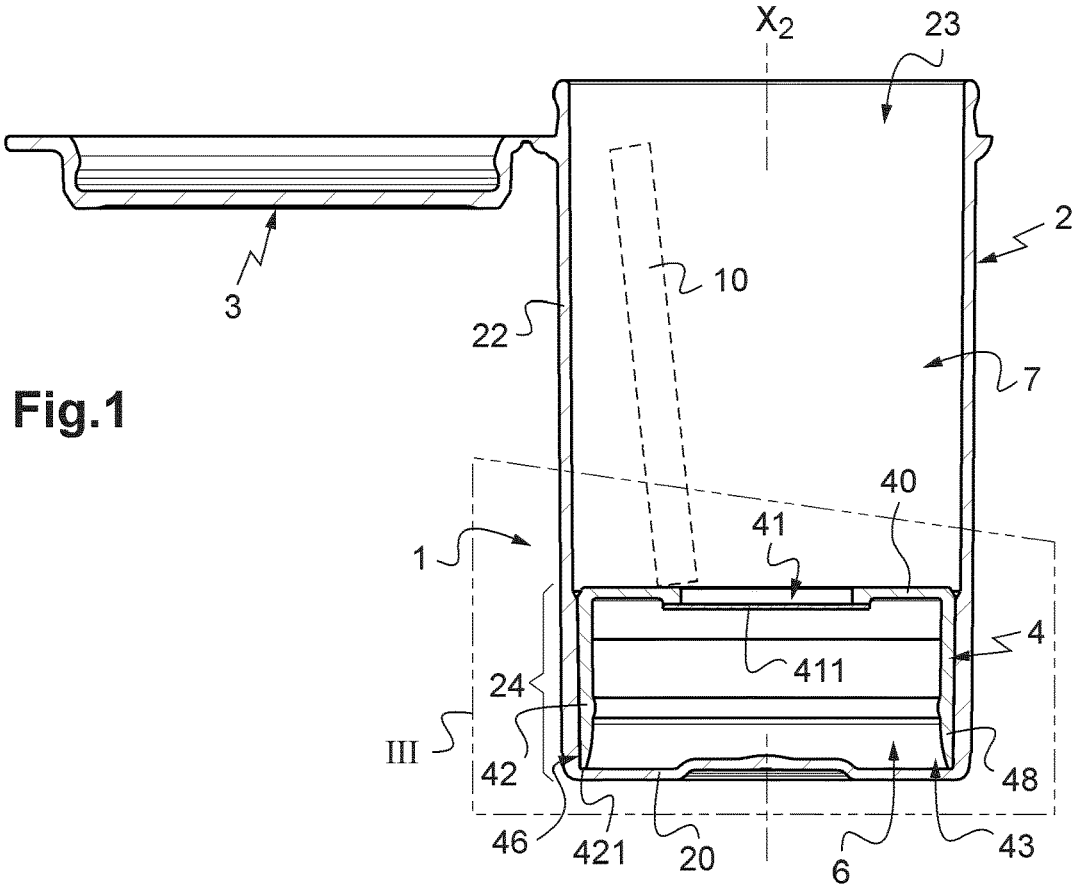
Fig.1
Fig.2
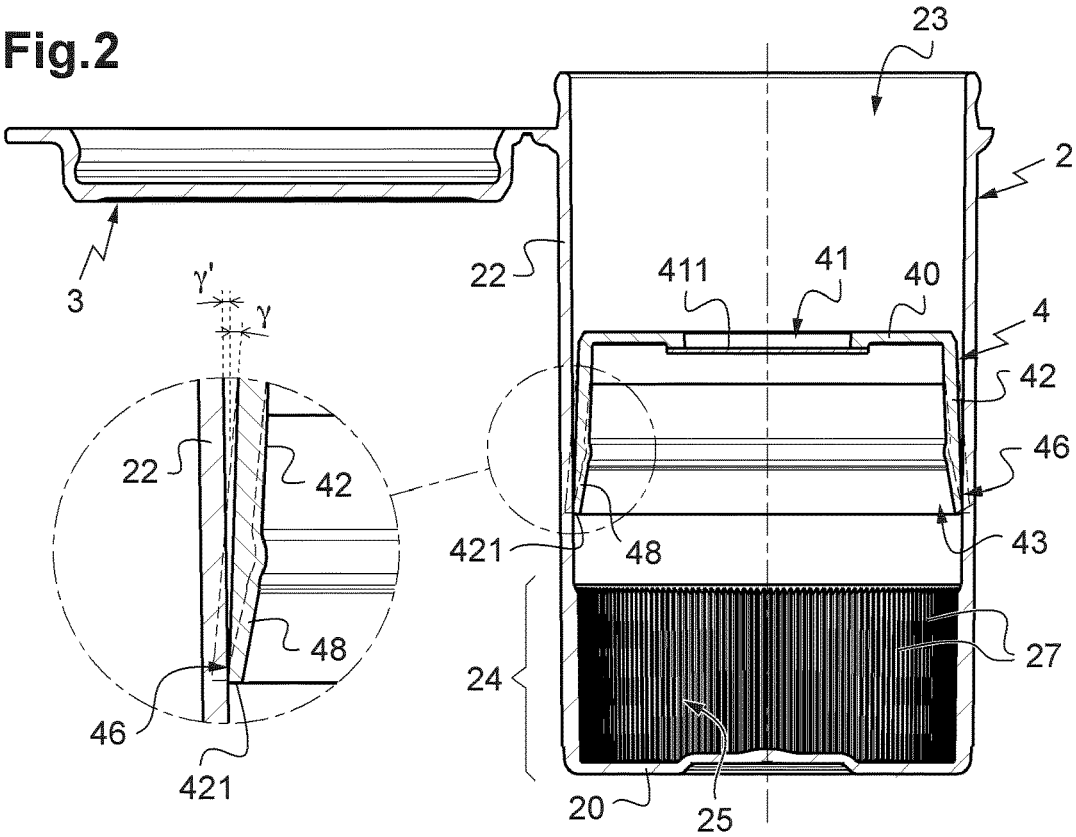

1
X2
7
22
10
2
411
41
40
VIII
VIII
27;47
4
L
24
42
27;47
48
46
421
20
5
6
43

4
40
41
411
47a
42
γ
46
45
421
47
47b

Fig.8
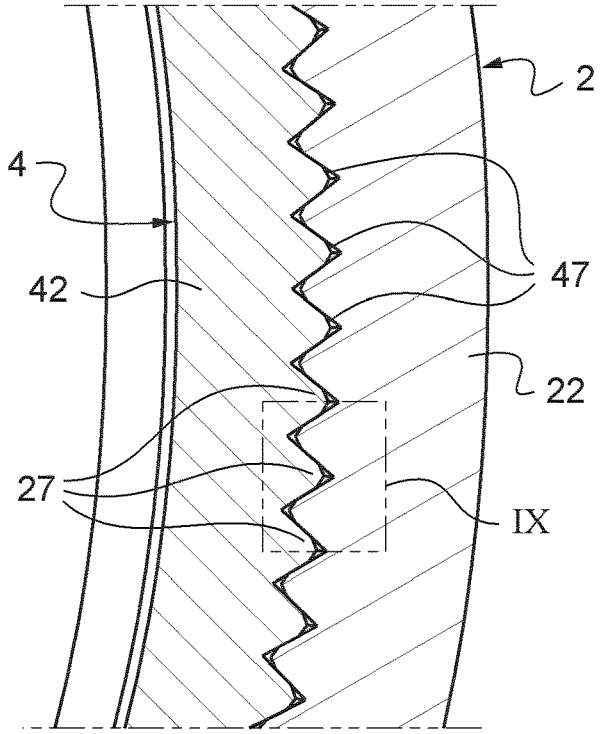
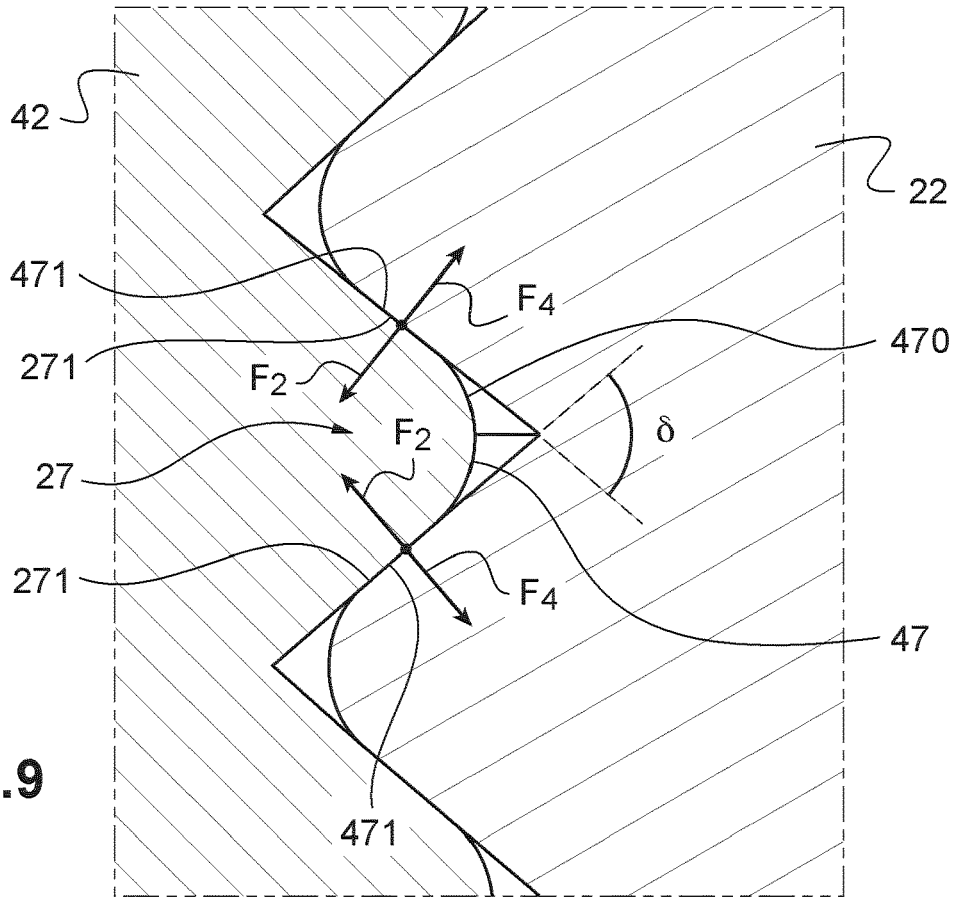
Fig.9

ASSEMBLY DEFINING A CHAMBER FOR AN ACTIVE MATERIAL AND METHOD FOR MANUFACTURING SUCH AN ASSEMBLY

FIELD OF THE INVENTION

The present invention relates to an assembly comprising a tubular body and an insert configured to be attached inside the tubular body so as to define a chamber in which gases and vapors can enter to interact with an active material received in the chamber. Such an assembly may be, in particular, a vial or a stopper, notably for the packaging of sensitive products such as food, nutraceutical products, pharmaceutical products or diagnostic products. The present invention also relates to a method for manufacturing such an assembly.

BACKGROUND OF THE INVENTION

In the packaging or medical device industry, it is known to create, in a container intended to receive sensitive products, a chamber filled with an active material, so that gases and vapors present in the container can enter the chamber and be absorbed by the active material. Throughout this text, the term "absorb", when referring to a given active material, is used to encompass all chemical and physical phenomena by which a gas may be retained by said active material. In particular, this includes bulk phenomena, generally referred to as "absorption", where gas molecules enter the active material; or surface phenomena, generally referred to as "adsorption", where gas molecules attach to the surface of the active material. Such a chamber filled with an active material may be provided, e.g., in a packaging for sensitive products such as food, nutraceutical products, pharmaceutical products or diagnostic products, or in a medical device, notably in an inhaler such as a DPI (Dry Powder Inhaler).

WO2016116551A1 discloses a container which forms an accommodating space for a packaged good, where the container body has a chamber for an active material delimited in a bottom part of the container body. More precisely, the chamber is closed by a moisture-permeable and/or gas-permeable cover, which is engaged behind a peripheral groove present on an internal face of the lateral wall of the container body. In this arrangement, the cover is locked between the active material and the peripheral groove. Then, the volume of active material received in the chamber must correspond to the volume of the chamber and cannot be modulated. The locking of the cover between the active material and the peripheral groove also does not allow for a robust attachment of the cover relative to the container body. In addition, the presence of the peripheral groove on the internal face of the container body limits the production rate of the container body by injection molding, i.e. increases the cycle time, since the cooling phase must be long enough to avoid damage of the groove shape prior to the release of the part from the tool.

EP2573007A1 discloses a container for accommodating sensitive products such as blood sugar test strips, urine test strips or tablets, comprising a container body and a desiccant storage case configured to be put in a bottom part of the container body. The desiccant storage case comprises an inner case intended to receive the desiccant, and a moisture transmission dustproof sheet closing an open end of the inner case. Grooves are formed on the outer circumferential wall of the inner case. In the assembled configuration, the moisture transmission dustproof sheet faces a bottom plate of the container body, while a gap is formed between the bottom plate and the moisture transmission dustproof sheet, so that the moisture in the container can pass through a space between the grooves of the inner case and the inner wall of the container body, to move into the gap from which it is transmitted through the moisture transmission dustproof sheet and adsorbed by the desiccant.

The structure described in EP2573007A1 requires the provision of spacers on the bottom plate of the container body to form the gap, which imposes a specific design of the container body or an additional assembly step if the spacers have to be placed at the bottom of the container body. In addition, a three-step pre-assembly of the desiccant storage case is needed before it can be inserted into the container body, comprising: filling the inner case with the desiccant, e.g. using a filling nozzle; aligning a pre-cut moisture transmission dustproof sheet with the open end of the inner case, e.g. using a suction arm; and sealing the open end of the inner case with the moisture transmission dustproof sheet, e.g. using an ultrasonic welding device. All of these preliminary steps result in a complex manufacturing process, limiting the production rate of the container and the possibility of using existing manufacturing lines. Furthermore, the presence of the gap between the moisture transmission dustproof sheet and the bottom plate of the container body causes a loss of space in the container.

It is these drawbacks that the invention is intended more particularly to remedy by proposing an assembly comprising a tubular body and an insert configured to be attached inside the tubular body so as to define a chamber, the manufacturing of this assembly being simple, easily automated, and allowing high production rates. The invention also proposes a method for manufacturing an assembly comprising a tubular body and an insert configured to be attached inside the tubular body to define a chamber, the manufacturing method being simple, easily automated, and allowing high production rates.

DISCLOSURE OF THE INVENTION

For this purpose, a subject of the invention is an assembly, such as a vial or a stopper, comprising a tubular body and a breathable insert configured to be attached inside the tubular body so as to define a chamber for an active material in the internal volume of the tubular body, the tubular body comprising a transverse wall and a lateral wall, the breathable insert comprising a base wall and a side wall having an open end on the opposite side from the base wall, wherein the chamber is delimited by a bottom part of the tubular body including the transverse wall and is closed by the breathable insert having its open end turned toward the transverse wall, wherein the side wall of the breathable insert comprises a mechanical holding portion configured to cooperate by surface interference with a corresponding mechanical holding portion of the lateral wall of the tubular body, the breathable insert being anchored relative to the tubular body by surface interference resulting from the mutual engagement of the mechanical holding portions, wherein, in the anchored configuration, a continuous peripheral seal is formed between the breathable insert and the tubular body.

According to one feature of the invention, in the anchored configuration, the side wall of the breathable insert and the lateral wall of the tubular body cooperate by cylinder-in-cylinder friction without undercut.

Within the meaning of the invention, the expression "cylinder-in-cylinder friction" refers to a friction between two substantially parallel cylindrical surfaces positioned one inside the other. According to its general definition, a cylinder is a solid delimited by a cylindrical surface and by two parallel planes, where the cylindrical surface is defined by a line, called generatrix, passing through a variable point describing a closed plane curve, called directing curve, and keeping a fixed direction. In other words, the generatrix line moves in space along the closed directing curve in a constant direction, thus creating the cylindrical surface. Preferably, a cylinder-in-cylinder friction is established between right cylindrical surfaces, i.e., cylindrical surfaces such that the generatrix lines are perpendicular to the bases of the cylinder. A cylinder-in-cylinder friction between two surfaces among which at least one surface has a slight draft angle, as common in the art to facilitate injection molding, typically of less than 2°, preferably of between 0.5 and 1°, is also possible in the context of the invention. It is understood that, within the frame of the invention, a cylinder-in-cylinder friction may be established between cylindrical surfaces not having circular bases, for example between cylindrical surfaces having oval bases, quadrilateral bases, or any other shape of bases defining a closed plane curve such as a broken line of crenelated shape for example.

Thanks to the invention, the breathable insert is attached securely to the tubular body, by surface interference between complementary mechanical holding portions of the breathable insert and the tubular body. Attachment by surface interference, or interference fit, corresponds to a deformation upon assembly of the breathable insert and the tubular body, such that the outer diameter of the breathable insert is higher before assembly than once the breathable insert is assembled with the tubular body. Typically, the deformation may be of the order of 0.5% to 3% in terms of circumference of the breathable insert.

In one embodiment of the invention, the mechanical holding portion of the side wall of the breathable insert may be formed by a smooth surface configured to cooperate by surface interference with a complementary smooth surface forming the mechanical holding portion of the lateral wall of the tubular body.

In another embodiment of the invention, the mechanical holding portion of the side wall of the breathable insert may be formed by a longitudinally striated surface configured to cooperate by surface interference with a complementary longitudinally striated surface forming the mechanical holding portion provided on the lateral wall of the tubular body substantially parallel to the longitudinal axis thereof.

In both embodiments, the mechanical holding portion of the side wall of the breathable insert and the mechanical holding portion of the lateral wall of the tubular body cooperate by cylinder-in-cylinder friction. Compared to snap fit holding portions comprising radial features in relief, such as the peripheral groove of the tubular body in WO2016116551A1, the mechanical holding portions of the invention make it possible to avoid any undercuts in the lateral wall of the tubular body and the side wall of the breathable insert. Thanks to this structure, it is possible to obtain the breathable insert and the tubular body easily by injection 20 molding, the risks of damage during release of the parts from the injection mold being low because the mechanical holding portions can be obtained without molding undercuts. The manufacturing of the assembly can also be totally automated, in particular the filling of the breathable insert with an active material can be automated, and immediately followed by the insertion of the filled breathable insert in the tubular body, thus allowing high production rates.

Advantageously, in the anchored configuration, the continuous peripheral seal formed between the breathable insert and the tubular body prevents any leakage of active material out of the chamber. The chamber of an assembly according to the invention may receive a great variety of active materials, including dehydrating agents (or desiccants) such as molecular sieves, silica gels, dehydrating clays; oxygen scavengers; odor absorbers; emitters of humidity or volatile olfactory organic compounds; or a mixture thereof. The assembly of the invention is also very versatile with respect to the physical form of the active material which may be, e.g., in the form of a powder, pellets, granules, tablets, or a mixture thereof.

In the context of the invention, it is understood that the continuous peripheral seal is not necessarily established between smooth facing surfaces of the breathable insert and the tubular body, but that the continuous peripheral seal may for example result from the interlocking of complementary features in relief provided on the breathable insert and the tubular body, as long as there is a continuous contact over the entire periphery of the breathable insert and the tubular body in the anchored configuration. In one embodiment, the continuous peripheral seal may be established between longitudinal features in relief of the breathable insert interlocking with longitudinal features in relief of the tubular body.

According to one feature of the invention, in the anchored configuration, the open end of the breathable insert is closed by the continuous peripheral seal formed between the breathable insert and the tubular body, without the need for any other closing member. This is very advantageous over the prior art, in particular compared to EP2573007A1 where the open end of the inner case has to be sealed with a moisture transmission dustproof sheet. On the contrary, in the present invention, the open end of the breathable insert remains open after the breathable insert has been filled with the active material, and the filled breathable insert with its open end still open is directly inserted in the tubular body. In practice, thanks to the relative arrangement of the tubular body and the breathable insert both during the insertion and in the anchored configuration, it is the tubular body itself which closes the open end of the breathable insert. This feature is key to reach high production rates.

According to one feature of the invention, the water vapor absorption rate of the breathable insert is higher than or equal to 80 mg/day at 25° C., 40% RH. The water vapor absorption rate of the breathable insert can be measured by a gravimetric test method in which the breathable insert is filled to at least 80% of its content capacity with a 4 Å molecular sieve having a moisture content of less than 3% at the beginning of the test. Thanks to the gas permeability of the breathable insert, gases can flow to and from the chamber through the breathable insert in the anchored configuration of the assembly. Thus, an active material contained in the chamber of the assembly can regulate the atmosphere outside the chamber.

According to one feature of the invention, the base wall of the breathable insert comprises a gas-permeable portion configured to prevent passage of the active material from the chamber to the outside of the chamber. Apart from the gas-permeable portion of the base wall, the rest of the breathable insert including the side wall may be made of a polymer-based material which is impermeable to gases. The gas-permeable portion ensures that gas can pass from the atmosphere surrounding products packaged in a container comprising the assembly, whereas pollution of the packaged products with the active material is prevented. In this way, the chamber formed by the assembly of the breathable insert and the tubular body is dust tight and gas permeable.

According to one feature, the gas-permeable portion comprises at least one hole covered with a gas-permeable protective sheet. The gas-permeable protective sheet makes it possible to avoid escape of the active material out of the chamber through the hole(s). In one embodiment, the gas-permeable protective sheet is a cardboard. In another embodiment, the gas-permeable protective sheet is a porous membrane closing the hole. In the latter case, the membrane is advantageously secured to a wall of the breathable insert around the periphery of the hole(s), e.g. by heat-sealing, ultrasonic welding, overmolding, etc. According to one embodiment, the membrane is a polymer membrane portion, such as a textile or fabric comprising polymer fibers, woven or non-woven, or a perforated polymer film. Examples of polymer fabrics that may be used for the membrane include non-woven fabrics based on polyethylene or polypropylene fibers. In particular, suitable materials include the products sold by DUPONT under the trademark TYVEK, which are spun-bonded non-woven fabrics comprising polyethylene fibers, in particular based on high-density polyethylene (HDPE) fibers. Examples of perforated polymer films that may be used for the membrane include perforated films of polyethylene or polypropylene.

According to one embodiment, in the anchored configuration, the continuous peripheral seal is formed between an end surface of the breathable insert and the transverse wall of the tubular body. In this embodiment, the continuous peripheral seal is obtained between surfaces of the breathable insert and the tubular body that are transverse to the longitudinal axis of the tubular body.

According to one embodiment, in the anchored configuration, the continuous peripheral seal is formed between the side wall of the breathable insert and the lateral wall of the tubular body. In this embodiment, the continuous peripheral seal is obtained between surfaces that are substantially parallel to the longitudinal axis of the tubular body.

According to one feature of the invention, the side wall of the breathable insert further comprises a smooth surface portion configured to slide in contact with the inner surface of the lateral wall of the tubular body upon insertion of the breathable insert in the tubular body, the smooth surface portion being positioned, on the breathable insert, at the front of the mechanical holding portion in a direction of insertion of the breathable insert in the tubular body. Thanks to its position at the front of the mechanical holding portion in a direction of insertion of the breathable insert in the tubular body, the smooth surface portion can be used as a scraper blade, or a squeegee, upon insertion of the breathable insert in the tubular body, to push the active material toward the bottom part of the tubular body and away from the mechanical holding portions of the breathable insert and the tubular body, making it possible to have an optimal quality of the mechanical attachment by surface interference between the mechanical holding portions. In this way, the presence of the smooth surface portion prevents any pollution of products stored in a container in which the atmosphere is regulated by means of the assembly of the invention. It is all the more important to avoid leakage of active material in the case of active materials with fine and light particles, such as silica gel or activated carbon, the particles of which are liable to stick to the facing walls of the breathable insert and the tubular body by electrostatic interaction.

According to one feature, the smooth surface portion is formed in the vicinity of a free edge delimiting the open end of the breathable insert. Such an arrangement, where the smooth surface portion is in the most forward position in the direction of insertion of the breathable insert in the tubular body, makes it possible to benefit from the "scraping effect" of the smooth surface portion as early as possible during the insertion, thus preventing particles of active material from becoming lodged between the side wall of the breathable insert and the lateral wall of the tubular body. Thanks to this most forward position of the smooth surface portion, it is also possible to maximize the longitudinal extension of the mechanical holding portion of the breathable insert at the rear of the smooth surface portion in the direction of insertion, and therefore the holding force of the attachment between the breathable insert and the tubular body in the anchored configuration.

According to one embodiment, upon insertion of the breathable insert in the tubular body with the open end turned toward the transverse wall, the side wall of the breathable insert and the lateral wall of the tubular body have draft angles which are in reverse angular directions. More precisely, the side wall of the breathable insert initially has a draft angle in a direction of widening away from the base wall, whereas the lateral wall of the tubular body initially has a draft angle in a direction of widening away from the transverse wall. Then, upon insertion of the breathable insert in the tubular body, since the open end of the breathable insert is turned toward the transverse wall of the tubular body, the side wall of the breathable insert is at an angle with respect to the lateral wall of the tubular body. As a result, the fitting between the two parts takes place stronger and earlier during the insertion, compared to a case where the side wall and the lateral wall are parallel to each other, in which case the fitting increases during the insertion and becomes strongest at the end of the insertion. The reverse draft angles of the breathable insert and the tubular body result in faster fitting with deformation of the breathable insert and the tubular body which conform to each other. According to one embodiment, the values of the draft angles for the side wall of the breathable insert and the lateral wall of the tubular body are selected to be less than 2°, preferably between 0.5° and 1°, preferably of the order of 0.5°.

According to one feature of the invention, the breathable insert and the tubular body are made of polymer-based materials having an elasticity. Advantageously, upon insertion of the breathable insert in the tubular body, the deformations of the breathable insert and the tubular body are kept within the elastic deformation range. In this way, the breathable insert and the tubular body are prevented from being plastically deformed. Thanks to their elasticity, the breathable insert and the tubular body can conform to each other during the insertion of the breathable insert in the tubular body, which results in a stronger anchoring of the breathable insert relative to the tubular body by surface interference According to one embodiment, the thickness of the side wall of the breathable insert is reduced in a distal region of the side wall in the vicinity of the smooth surface portion. Such a thinned distal region, which is the first region of the breathable insert contacting the tubular body in the direction of insertion of the breathable insert in the tubular body, provides greater flexibility for the breathable insert to be deformed upon insertion. The thinned distal region also makes it possible to absorb a potential difference in draft angles between the breathable insert and the tubular body as quickly as possible and to absorb any geometric defect in circularity because the flexibility of the breathable insert implies an easier adaptability to slight design variations such as ovality generated for example by the production and cooling process of the component or due to some intermediate storage conditions.

According to one embodiment, the mechanical holding portion of the side wall of the breathable insert comprises a plurality of longitudinal features in relief configured to cooperate by mutual engagement with complementary longitudinal features in relief provided on the mechanical holding portion of the lateral wall of the tubular body substantially parallel to the longitudinal axis thereof. Compared to mechanical holding portions with smooth cylindrical surfaces, the presence of the longitudinal features in relief ensures a tightening over a larger surface area, which results in a stronger anchoring of the breathable insert relative to the tubular body by surface interference. In particular, the greater surface area of physical interference obtained by virtue of the features in relief increases the frictional force at the interface between the breathable insert and the tubular body, and therefore decreases the risk of disassembly.

Within the frame of the invention, the plurality of longitudinal features in relief of the breathable insert are a plurality of recessed or projecting patterns with respect to an outer general surface of the side wall of the breathable insert, such as longitudinal ribs or grooves. In a similar way, the plurality of longitudinal features in relief of the tubular body are a plurality of projecting or recessed patterns with respect to an inner general surface of the peripheral wall of the tubular body, complementary to the recessed or projecting patterns of the breathable insert, such as longitudinal grooves or ribs. Throughout this text, a feature in relief is complementary to another feature in relief when it is configured to cooperate and interlock with the other feature, and the two features may have the same shape or different shapes. For example, two complementary features in relief may both have a V-shaped cross section, or they may include a first feature with a V-shaped cross section and a second feature with a rectangular cross section suitable for receiving and interlocking with the V-shaped first feature.

According to one feature, an end of the longitudinal features in relief of the breathable insert is at a distance from the smooth surface portion of the breathable insert. In this way, the presence of the longitudinal features in relief does not alter the quality of the "scraping effect" of the smooth surface portion, which slides in contact with the inner surface of the lateral wall of the tubular body upon insertion of the breathable insert in the tubular body, thus preventing the passage of particles of active material toward the outside of the chamber.

According to one feature, the plurality of longitudinal features in relief of the breathable insert are distributed circumferentially over the periphery of the mechanical holding portion. This contributes to a strong anchoring of the breathable insert inside the tubular body over the entire periphery of the assembly.

According to one embodiment, at least one longitudinal feature in relief of one among the breathable insert and the tubular body has two flanks inclined with respect to a radial direction of the breathable insert or tubular body passing through the feature in relief, and, in the anchored configuration, both inclined flanks of the at least one longitudinal feature in relief of the one among the breathable insert and the tubular body are in contact with a complementary longitudinal feature in relief of the other one among the breathable insert and the tubular body. It is understood here that the complementary longitudinal feature in relief of the other one among the breathable insert and the tubular body may either also have two inclined flanks, or may not have two inclined flanks. In the anchored configuration of the breathable insert relative to the tubular body, the arrangement of the two inclined flanks of at least one feature in relief in contact with a complementary longitudinal feature in relief of the other part, provides not only a tightening in the radial direction of the assembly, but also a transverse tightening on the inclined flanks, which is substantially circumferential. This results in a stronger anchoring of the breathable insert inside the tubular body by surface interference.

According to one embodiment, a plurality of longitudinal features in relief of one part among the breathable insert and the tubular body, distributed circumferentially over the periphery of the part, have two flanks inclined with respect to a radial direction of the breathable insert or tubular body passing through the considered feature in relief and, in the anchored configuration of the breathable insert relative to the tubular body by surface interference, both inclined flanks of each longitudinal feature in relief having inclined flanks are in contact with a complementary longitudinal feature in relief of the other part among the breathable insert and the tubular body. In this embodiment, since a plurality of features in relief of one part, distributed circumferentially, have inclined flanks and are in contact with complementary features in relief of the other part in the anchored configuration, the resulting transversal tightening on the inclined flanks is distributed over the periphery of the assembly. This contributes to a strong anchoring of the breathable insert inside the tubular body over the entire periphery of the assembly.

According to one embodiment, at least one longitudinal feature in relief of the breathable insert has two flanks inclined with respect to a radial direction of the breathable insert passing through the feature in relief, whereas at least one longitudinal feature in relief of the tubular body has two flanks inclined with respect to a radial direction of the tubular body passing through the feature in relief, and, in the anchored configuration of the breathable insert inside the tubular body by surface interference, the two inclined flanks of the at least one longitudinal feature in relief of the breathable insert are in contact with the two inclined flanks of the at least one longitudinal feature in relief of the tubular body. In this embodiment, there are at least two complementary features in relief, including one on the breathable insert and one on the tubular body, each having two inclined flanks and, in the anchored configuration of the breathable insert relative to the tubular body, the two complementary features in relief having inclined flanks are mutually engaged and the inclined flanks are in contact by pairs. In this case, the inclination of the cooperating flanks relative to the radial direction of the assembly ensures a tightening over a larger surface of the complementary features compared to, e.g., ribs and grooves of rectangular cross section with side walls parallel to the radial direction. This results in a stronger anchoring of the breathable insert inside the tubular body by surface interference.

According to one embodiment, a plurality of longitudinal features in relief of the breathable insert, distributed circumferentially over the outer periphery of the breathable insert, have two flanks inclined with respect to a radial direction of the breathable insert passing through the considered feature in relief, whereas a plurality of longitudinal features in relief of the tubular body, distributed circumferentially over the inner periphery of the tubular body, have two flanks inclined with respect to a radial direction of the tubular body passing through the considered feature in relief, and, in the anchored configuration of the breathable insert inside the tubular body by surface interference, longitudinal features in relief of the breathable insert having inclined flanks are engaged with complementary features in relief of the tubular body also having inclined flanks, such that the inclined flanks are in contact by pairs. This embodiment combines the advantages of the above embodiments, i.e., thanks to the circumferential distribution of the features in relief having inclined flanks, the resulting transversal tightening on the inclined flanks, which is substantially circumferential, is distributed over the periphery of the assembly; and, for each pair of complementary longitudinal features in mutual engagement both having inclined flanks, the inclination of the cooperating flanks relative to the radial direction of the assembly ensures a tightening over a larger surface of the complementary features. This contributes to a strong anchoring of the breathable insert inside the tubular body over the entire periphery of the assembly.

In one embodiment, in a section perpendicular to the longitudinal axis of the assembly, the inclined flanks of the features in relief of the breathable insert having inclined flanks follow a homothetic profile of the inclined flanks of the features in relief of the tubular body having inclined flanks, according to the two different diameters of the breathable insert and the tubular body. Then, the breathable insert and the tubular body have a same pattern of inclined surfaces. Thanks to the complementary shapes, the contact pressure occurs not only in the radial direction of the assembly, but also on the inclined flanks perpendicularly to the inclined flanks, i.e. substantially circumferentially.

According to one embodiment, the longitudinal features in relief of the tubular body, respectively the longitudinal features in relief of the breathable insert, are contiguous to one another on the periphery of the tubular body, respectively on the periphery of the breathable insert. According to one feature, the longitudinal features in relief of the tubular body, respectively the longitudinal features in relief of the breathable insert, form at least one striated surface on the inner periphery of the tubular body, respectively on the outer periphery of the breathable insert. In particular, the breathable insert and the tubular body may each comprise several striated surfaces distinct from one another and distributed around their periphery.

According to one embodiment, the breathable insert comprises on its outer periphery a plurality of longitudinal ribs, each longitudinal rib having a rounded or chamfered end portion at each end of the longitudinal rib which is configured to interact first with a complementary longitudinal groove provided on the inner periphery of the tubular body upon engagement of the breathable insert in the tubular body. Such rounded or chamfered end portions of the ribs make it possible to initiate easily the engagement of the longitudinal ribs of the breathable insert with the longitudinal grooves of the tubular body, without having to precisely align the patterns. According to one feature, each rounded or chamfered end portion of a longitudinal rib has a chamfer angle of between 5° and 30° with respect to the side wall of the breathable insert.

According to one embodiment, the length over which the longitudinal features in relief cooperate by mutual engagement is higher than 1/10 of the diameter of the tubular body, preferably higher than 1/6 of the diameter of the tubular body. The diameter of the tubular body which is considered for this evaluation is the diameter of the surface of the lateral wall the tubular body which comprises the longitudinal features in relief, i.e. the inner surface of the lateral wall, taken at that end of the longitudinal features in relief engaged with those of the breathable insert which is furthest from the transverse wall of the tubular body. Such a length of interaction between the features in relief ensures a strong attachment of the breathable insert inside the tubular body.

According to one embodiment, the successive longitudinal features in relief on the outer surface of the side wall of the breathable insert are distributed, in the circumferential direction of the side wall, with an angular pitch between two successive features in relief of less than 3°, preferably of the order of 2°. It is noted that, due to the complementary shape of the features in relief of the tubular body, the angular pitch between the features in relief on the inner surface of the lateral wall of the tubular body is the same as that between the features in relief of the breathable insert. Such an angular pitch of the successive features in relief on the breathable insert and the tubular body provides a number of the complementary features in relief which ensures that the breathable insert is properly anchored inside the tubular body by surface interference. In particular, the higher the number of features in relief, the higher the tightening of the breathable insert with respect to the tubular body.

According to one feature, the breathable insert comprises on its outer periphery a plurality of longitudinal ribs each having a V-shaped cross section comprising an apex and two flanks, where each flank extends from the apex and is inclined with respect to a radial direction of the breathable insert passing through the apex. According to one feature, the tubular body comprises on its inner periphery a plurality of longitudinal grooves each having a V-shaped cross section comprising a bottom and two flanks, where each flank extends from the bottom and is inclined with respect to a radial direction of the tubular body passing through the bottom. According to one embodiment, the angle at the apex of each longitudinal rib of the breathable insert may be the same as the angle at the bottom of each longitudinal groove of the tubular body. According to another embodiment, the angle at the apex of each longitudinal rib of the breathable insert may be higher than the angle at the bottom of each longitudinal groove of the tubular body, e.g. with an angle difference of the order of 2° to 10°. It may be interesting to have ribs of the breathable insert with a slightly higher top angle, i.e. slightly more open than the grooves the tubular body, to promote the contact on the inclined flanks and enhance radial interference.

In one embodiment, the two flanks of each longitudinal rib of the breathable insert are inclined relative to each other at an angle of between 70° and 90°, preferably of the order of 80°. According to one feature, each longitudinal rib of the breathable insert has a peak-to-valley height higher than 0.2 mm, preferably higher than 0.3 mm. Of course, due to their complementary shape, the features in relief of the tubular body also have similar ranges for their top angle and peak-to-valley height.

According to one feature, the two flanks of each longitudinal rib of the breathable insert are inclined at a same angle on both sides of the radial direction passing through the apex, i.e. the radial direction passing through the apex is the bisector of the angle at the apex of each longitudinal rib, and it is the same for the two flanks of each longitudinal groove of the tubular body. According to one embodiment, the angle at the apex of each longitudinal rib of the breathable insert, respectively the angle at the bottom of each longitudinal groove of the tubular body, is between 70° and 90°, preferably of the order of 80°. According to one embodiment, for each longitudinal rib of the breathable insert, the inclination angle of each flank relative to a radial direction passing through the apex of the rib is between 35° and 45°, preferably of the order of 40°. According to one embodiment, for each longitudinal groove of the tubular body, the inclination angle of each flank relative to a radial direction passing through the bottom of the groove is between 35° and 45°, preferably of the order of 40°.

According to one feature, the bottom of each longitudinal groove of the tubular body has a pointed shape, whereas the apex of each longitudinal rib of the breathable insert has a rounded shape. In this way, for each pair of complementary longitudinal rib and groove in mutual engagement, a gap, i.e. an empty space, is left between the apex of the rib and the bottom of the groove. This gap allows a deformation of the longitudinal ribs of the breathable insert and the longitudinal grooves of the tubular body in mutual engagement, so that the contact surface, and thus the tightening, between the breathable insert and the tubular body is maximized. The curvature (or truncation, e.g. to form a trapezoidal rather than a triangular profile in cross section) at the apex of each longitudinal rib of the breathable insert also improves contact on the inclined flanks by avoiding a contact at a pointed end of the rib which would lead to a radial (centripetal) tightening force and would be less effective. It is noted that, when the longitudinal features in relief of the breathable insert, respectively the longitudinal features in relief of the tubular body, are contiguous, a bottom is formed between two adjacent ribs of the breathable insert, whereas an apex is formed between two adjacent grooves of the tubular body. In this case, the same configuration, with a pointed shape of each bottom of the breathable insert and a rounded shape of each apex of the tubular body, is also advantageously implemented so that a gap is present between each pair of facing apex and bottom.

According to one feature, the chamfer at the junction between the base wall and the side wall of the breathable insert is less than 0.5 mm, preferably less than or equal to 0.2 mm. Such a small chamfer helps reduce the trapping of dust which may originate from products stored in a container in which the atmosphere is regulated by means of the assembly of the invention.

According to one embodiment, in the anchored configuration, the breathable insert is in contact with the transverse wall of the tubular body. This arrangement advantageously corresponds to a maximum longitudinal engagement between the mechanical holding portions of the breathable insert and the tubular body. In addition, in this case, the volume of the chamber or any sub-compartment of the chamber is known, making it possible to adjust the quantity of active material so that it corresponds to the volume of the chamber or sub-compartment of the chamber. Then, in the anchored configuration of the breathable insert inside the tubular body with the breathable insert in contact against the transverse wall of the tubular body, a loose distribution of the particles of the active material can be avoided, which may otherwise generate noise.

According to one embodiment, the breathable insert comprises an inner tubular wall defining, in the internal volume of the breathable insert delimited by the base wall and the side wall, a sub-compartment of adjusted volume. In this embodiment, it is possible to adjust the volume of the sub-compartment so that it corresponds to a desired quantity of active material in the chamber for a given application. For example, the quantity of active material in the chamber can be modulated to reach a desired level of regulation of the atmosphere within a container, or it can be varied based on the properties, such as the moisture content, of the products to be stored in a container in which the atmosphere is regulated by means of the assembly of the invention. In practice, the sub-compartment of adjusted volume is fully filled with the active material before the breathable insert is inserted in the tubular body. Then, in the anchored configuration, the active material is closely surrounded by the walls of the sub-compartment and the transverse wall of the tubular body and cannot move in the chamber, thus preventing noise from being generated (e.g. similar to a "maracas") which may otherwise be generated in the event of a loose distribution of the particles of the active material in the chamber.

According to one embodiment, the breathable insert and/or the tubular body can be obtained from injectable thermoplastic materials made in such a way that they act themselves as atmosphere regulators, e.g. capable of absorbing various different chemicals such as humidity, oxygen, odor and other possible pollutants. In this case, the thermoplastic materials constituting the breathable insert and/or the tubular body are themselves formulated with additives belonging to a group of: humidity absorbers; oxygen scavengers; odor absorbers; and/or emitters of humidity or volatile olfactory organic compounds. Examples of suitable additives include the dehydrating agents and oxygen collecting agents listed above. It is noted that the thermoplastic materials formulated with such additives exhibit a lower elasticity. However, a lower elasticity is compatible with the assembly according to the invention, where the breathable insert is anchored inside the tubular body by surface interference. In particular, such an assembly process does not require the same degree of resilience of the parts as is required, e.g., for a locking by snap fit with a peripheral groove.

In particular, when the breathable insert is an active insert made of a polymer-based material including an active material, it is possible to combine the action of the active material received in the chamber and the action of the active material present in the composition of the breathable insert. In one embodiment, the breathable insert may be a desiccant insert, with a polymer composition comprising a thermoplastic base polymer and an inorganic desiccant material as the active material, preferably selected from the group comprising molecular sieves, zeolites, silica gel, clay, hydrate salts, metal oxides and mixtures thereof, as disclosed for example in WO2019197165A1. In another embodiment, the breathable insert may be a flavored insert, with a polymer composition comprising a thermoplastic base polymer and a scented adjuvant as the active material, preferably selected from volatile olfactory organic compounds.

According to one feature, the breathable insert is housed inside the tubular body so that the chamber for an active material is defined within the internal volume of the tubular body.

In one embodiment of the invention, the assembly is a vial for the storage of products, in particular sensitive products, the tubular body being a container inside which the breathable insert delimits two compartments located on both sides of the breathable insert, including the chamber for an active material on one side, in the internal volume of the breathable insert, and a fillable tank for the storage of products on the other side of the breathable insert, in the rest of the internal volume of the tubular body out of the breathable insert.

In another embodiment of the invention, the tubular body and the breathable insert are part of a stopper inside which they delimit the chamber for an active material, the stopper being configured to close a container intended to receive products, in particular sensitive products, and regulate the atmosphere inside the container.

According to one embodiment, the chamber is filled with an active material, in particular in a powder or granular state, which may be any type of active material. Within the meaning of the invention, an active material is a material capable of regulating the atmosphere in a container, especially in a container intended to receive sensitive products. In particular, the active material may belong to a group of: humidity absorbers; oxygen scavengers; odor absorbers; and/or emitters of humidity or volatile olfactory organic compounds. Optionally, the active material may be capable of releasing gaseous substances such as moisture or perfume. Such properties can for example be useful for applications where sensitive products require a certain humidity level. Such products are, for example, powders, especially for generating aerosols, gelatin capsules, herbal medicine, gels and creams including cosmetics, food products, etc.

Examples of suitable dehydrating agents include, without limitation, silica gels, dehydrating clays, activated alumina, calcium oxide, barium oxide, natural or synthetic zeolites, molecular or similar sieves, or deliquescent salts such as magnesium sulfide, calcium chloride, aluminum chloride, lithium chloride, calcium bromide, zinc chloride or the like. Preferably, the dehydrating agent is a molecular sieve and/or a silica gel.

Examples of suitable oxygen collecting agents include, without limitation, metal powders having a reducing capacity, in particular iron, zinc, tin powders, metal oxides still having the ability to oxidize, in particular ferrous oxide, as well as compounds of iron such as carbides, carbonyls, hydroxides, used alone or in the presence of an activator such as hydroxides, carbonates, sulfites, thiosulfates, phosphates, organic acid salts, or hydrogen salts of alkaline metals or alkaline earth metals, activated carbon, activated alumina or activated clays. Other agents for collecting oxygen can also be chosen from specific reactive polymers such as those described for example in the patent documents U.S. Pat. No. 5,736,616 A, WO 99/48963 A2, WO 98/51758 A1 and WO 2018/149778 A1.

According to one feature, each one of the breathable insert and the tubular body is made of a suitable polymer-based material. Examples of suitable polymer materials include, without limitation, radical or linear high- and low-density polyethylene, copolymers of ethylene such as for example ethylene vinyl acetates, ethylene ethyl acrylates, ethylene butyl acrylates, ethylene maleic anhydrides, ethylene alpha olefins, regardless of the methods of polymerization or modification by grafting, polypropylene, polybutylene, polyisobutylene. Polyolefins are advantageously selected to make the breathable insert and the tubular body, for cost reasons and because they are easy to use. However, other polymer materials can also be considered, such as polyvinyl chloride, copolymers of vinyl chloride, polyvinylidene chlorides, polystyrenes, copolymers of styrene, derivatives of cellulose, polyamides, polycarbonates, polyoxymethylenes, polyethylene terephthalates, polybutylene terephthalates, copolyesters, polyphenylene oxides, polymethyl methacrylates, copolymers of acrylate, fluoride polymers, polyimides, polyurethanes, etc.

Combinations of these polymers can be used, if desired. The polymers used to produce the breathable insert and the tubular body can also contain one or more additives such as fibers, expanding agents, additives such as stabilizers and colorants, sliding agents, demolding agents, adhesion agents or reinforced catching agents and/or any others according to the requirements of usage.

According to one embodiment, the Young's modulus of the constitutive material of the breathable insert is less than or equal to the Young's modulus of the constitutive material of the tubular body. When the constitutive materials of the breathable insert and the body have substantially the same Young's modulus, the fitting of the breathable insert inside the tubular body may be enhanced, through the establishment of a balanced interaction between the longitudinal features in relief of the two parts. The selection of a material having a lower Young's modulus for the breathable insert can allow for an easier engagement of the breathable insert inside the tubular body.

Another subject of the invention is a method for manufacturing an assembly as described above, comprising steps of:

filling at least part of the internal volume of the breathable insert with an active material;

inserting the filled breathable insert in the tubular body with its open end turned toward the transverse wall of the tubular body, until the anchored configuration is reached, in which the mechanical holding portion of the breathable insert is engaged with the corresponding mechanical holding portion of the tubular body and a continuous seal is formed between the breathable insert and the tubular body.

Another subject of the invention is a method for manufacturing an assembly, such as a vial or a stopper, comprising a tubular body and a breathable insert configured to be attached inside the tubular body so as to define a chamber for an active material in the internal volume of the tubular body, the tubular body comprising a transverse wall and a lateral wall, the breathable insert comprising a base wall and a side wall having an open end on the opposite side from the base wall, the chamber being delimited by a bottom part of the tubular body including the transverse wall and being closed by the breathable insert having its open end turned toward the transverse wall, the side wall of the breathable insert comprising a mechanical holding portion configured to cooperate by surface interference with a corresponding mechanical holding portion of the lateral wall of the tubular body, wherein the method comprises steps of:

filling at least part of the internal volume of the breathable insert with an active material;

inserting the filled breathable insert in the tubular body, with its open end turned toward the transverse wall of the tubular body, until the breathable insert is anchored relative to the tubular body by surface interference resulting from the mutual engagement of the mechanical holding portions and a continuous peripheral seal is formed between the breathable insert and the tubular body.

Advantageously, the manufacturing method can be totally automated. In particular, the filling of the breathable insert with the active material can be automated, and immediately followed by the insertion of the filled breathable insert in the tubular body, without the need for closing the breathable insert, thus allowing high production rates.

According to one feature, the mechanical holding portion of the side wall of the breathable insert comprises a plurality of longitudinal features in relief configured to cooperate by mutual engagement with complementary longitudinal features in relief provided on the mechanical holding portion of the lateral wall of the tubular body substantially parallel to the longitudinal axis thereof.

According to one feature of the manufacturing method, the open end of the breathable insert remains open after the breathable insert has been filled with the active material, and the filled breathable insert is inserted in the tubular body with its open end still open, wherein, upon insertion of the filled breathable insert in the tubular body, the breathable insert is positioned with its open end facing upward while the tubular body is positioned with its open end facing downward.

According to one feature of the manufacturing method, upon insertion of the filled breathable insert in the tubular body, the breathable insert is held stationary while the tubular body is displaced over the breathable insert, e.g., by being pushed or pulled over the breathable insert. Advantageously, the filled breathable insert is held stationary during all steps of the manufacturing method until the anchored configuration is reached, thus limiting the risk of active material falling out of the breathable insert and of wasting the active material.

According to one feature of the manufacturing method, the filled breathable insert is inserted in the tubular body until it abuts against the transverse wall of the tubular body.

Compared to a manufacturing method where the tubular body is filled with an active material and the breathable insert is inserted in the tubular body in an empty state, the manufacturing method as described above, in which the active material is poured directly into the breathable insert having a cup shape and the tube is turned upside down and displaced over the filled breathable insert, has several advantages.

First, the duration of the step of filling with the active material is significatively reduced, since the height of the breathable insert is lower than that of the tubular body. In addition, there is a reduced risk of having particles of active material which fall out of the tubular body during the filling step, or particles which remain stuck to the lateral wall of the tubular body by electrostatic interaction and which are likely to remain outside the breathable insert and interfere with the correct engagement of the mechanical holding portions of the breathable insert and the tubular body.

Importantly, the filling of the breathable insert before its insertion in the tubular body allows to overcome limitations in the assembly speed, which would otherwise apply in the case where the tubular body is filled with the active material. In particular, due to the air exhaust which passes between the two parts upon assembly, volatile particles of active material may be ejected toward the gap defined between the walls of the breathable insert and the tubular body and, if the particle size is greater than a thickness of the gap, they may get stuck in the gap. This may alter the cooperation between the mechanical holding portions of the breathable insert and the tubular body and reduce the quality of the mechanical attachment by surface interference. Additionally, this may lead to the passage of smaller particles along the sides of the stuck particles, thus resulting in a possible pollution of products stored in a container comprising the assembly of the invention.

On the contrary, in the manufacturing method as described above, the smooth surface portion of the breathable insert can be used as a scraper blade to push the active material toward the bottom part of the tubular body and away from the mechanical holding portions of the breathable insert and the tubular body, which ensures an optimal quality of the mechanical attachment by surface interference between the mechanical holding portions.

BRIEF DESCRIPTION OF THE DRAWINGS

Features and advantages of the invention will become apparent from the following description of several embodiments of an assembly and a method according to the invention, this description being given merely by way of example and with reference to the appended drawings in which:

FIG. 1 is a longitudinal section of an assembly according to a first embodiment of the invention, being a vial for the storage of products such as diagnostic test strips, which comprises a container including a tubular body inside which a breathable insert delimits two compartments located on both sides of the breathable insert, i.e. the chamber for an active material on one side and a fillable tank on the other side;

FIG. 2 is a cross section similar to FIG. 1, in a configuration where the breathable insert is being inserted in the tubular body, the initial state of the breathable insert before its insertion in the tubular body being shown in dotted lines to show the deformation upon insertion and the respective initial draft angles of the breathable insert and the tubular body;

FIG. 8 is a cross section at larger scale along the line VIII-VIII of FIG. 3;

FIG. 9 is a view at larger scale of the detail IX of FIG. 8;

ILLUSTRATIVE EMBODIMENTS OF THE INVENTION

Figure 3:
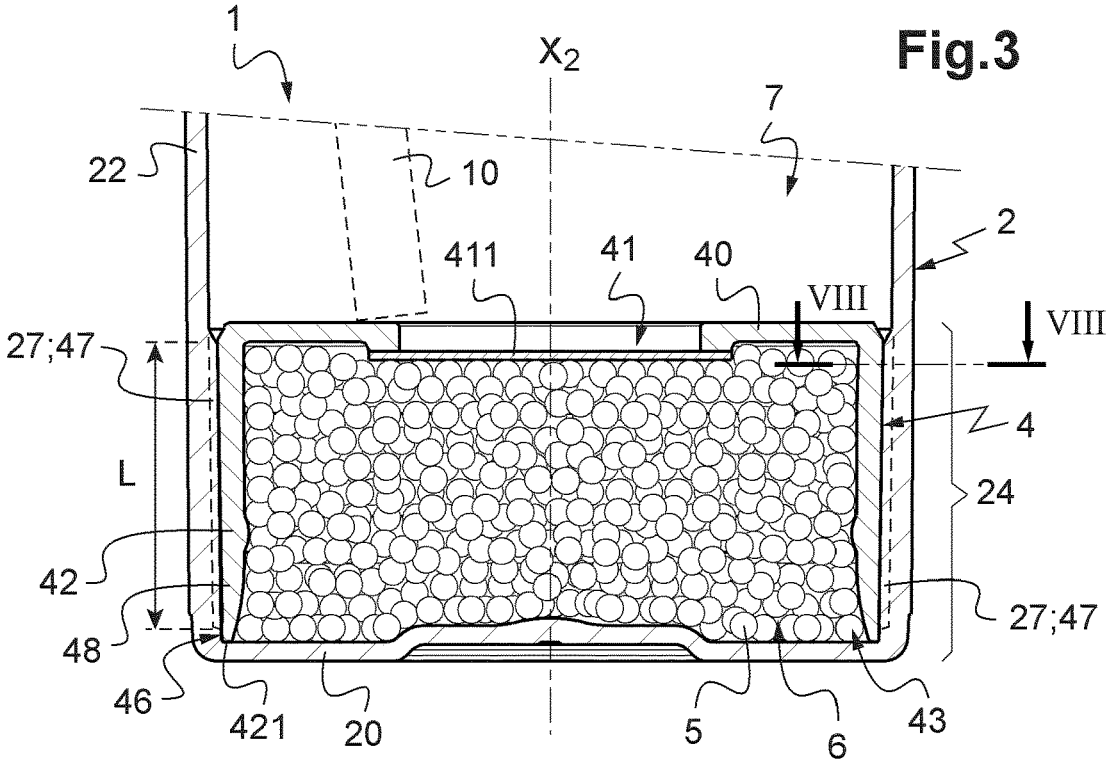
FIG. 3 is a view at larger scale of the detail III of FIG. 1, the chamber being filled with an active material.

In the first embodiment shown in FIGS. 1 to 10, the assembly 1 according to the invention is a vial for the storage of moisture sensitive products, such as diagnostic test strips, or nutraceutical or pharmaceutical products e.g. in the form of pills, lozenges or tablets, notably effervescent tablets. The assembly 1 comprises a moisture-proof container, including a tubular body 2 and a lid 3 for hermetically closing the tubular body 2. The tubular body 2 and the lid 3 are connected to each other via a hinge, such as a film hinge. The assembly 1 also comprises a breathable insert 4, attached inside the tubular body 2, which delimits two compartments located on both sides of the breathable insert 4, including a chamber 6 for an active material on one side and a fillable tank 7 for sensitive products on the other side.

By way of a non-limiting example, the sensitive products received in the tank 7 may be diagnostic test strips 10, or nutraceutical or pharmaceutical products e.g. in the form of pills, lozenges or tablets, whereas the active material 5 received in the chamber 6 may be a dehydrating agent (or desiccant) in a powder or granular form, e.g. selected from molecular sieves, silica gels and/or dehydrating clays. The tubular body 2 has a circular cross section, and comprises a transverse wall 20, a lateral wall 22 and an open end 23 on the opposite side from the transverse wall 20, which is configured to be closed by the lid 3. The breathable insert 4 also has a tubular shape with a circular cross section, and comprises a base wall 40, a side wall 42, and an open end 43 on the opposite side from the base wall 40.

The chamber 6 for the active material 5 is delimited by a bottom part 24 of the tubular body 2 including the transverse wall 20, and it is closed by the breathable insert 4. As clearly visible in FIGS. 1 to 3, the breathable insert 4 is positioned in the tubular body 2 such that its open end 43 is turned toward the transverse wall 20. The base wall 40 of the breathable insert 4 comprises a central hole 41, which is covered with a gas-permeable membrane 411 to avoid escape of the active material 5 out of the chamber 6 through the hole. The breathable insert 4 is advantageously obtained by injection molding, through injection of a thermoplastic material in a mold in which the membrane 411 has previously been positioned, so as to form the body of the breathable insert 4 and simultaneously bond the membrane 411 to the edge of the hole 41 under the effect of the heat and/or the pressure generated during injection molding.

As best seen in FIGS. 4 to 10, for the attachment of the breathable insert 4 relative to the tubular body 2, the side wall 42 of the breathable insert 4 comprises on its outer surface a plurality of longitudinal ribs 47 configured to cooperate by mutual engagement with complementary longitudinal grooves 27 provided on the inner surface of the lateral wall 22 of the tubular body 2, in the vicinity of the bottom part 24. The longitudinal grooves 27 are substantially parallel to the longitudinal axis $X_2$ of the tubular body 2. In the assembled configuration shown in FIGS. 1 and 3, the longitudinal ribs 47 of the breathable insert 4, which are engaged with the longitudinal grooves 27 of the tubular body 2, are also substantially parallel to the longitudinal axis $X_2$.

The longitudinal ribs 47 and the longitudinal grooves 27 are configured in such a way that, when the longitudinal ribs 47 of the breathable insert 4 are engaged with the longitudinal grooves 27 of the tubular body 2, the breathable insert 4 is anchored relative to the tubular body 2 by surface interference. More precisely, as shown in the cross section of FIGS. 8 and 9, each longitudinal rib 47 of the breathable insert 4 has a V-shaped cross section comprising an apex 470 and two flanks 471, where each flank 471 extends from the apex 470 and is inclined with respect to a radial direction of the breathable insert 4 passing through the apex 470. In a similar way, each longitudinal groove 27 of the tubular body 2 has a V-shaped cross section comprising a bottom 270 and two flanks 271, where each flank 271 extends from the bottom 270 and is inclined with respect to a radial direction of the tubular body 2 passing through the bottom 270. In this embodiment, the angle at the apex of each longitudinal rib 47 is substantially the same as the angle at the bottom of each longitudinal groove 27, denoted 8 in the figures.

Preferably, as shown in the figures, the two flanks 471 of each longitudinal rib 47 are inclined at a same angle on both sides of the radial direction passing through the apex 470, i.e. the radial direction passing through the apex 470 is the bisector of the angle at the apex of each longitudinal rib 47, and it is the same for the two flanks 271 of each longitudinal groove 27. By way of a non-limiting example, in the illustrated embodiment, the angle δ at the apex of each longitudinal rib 47, respectively at the bottom of each longitudinal groove 27, is of the order of 80°. In the assembled configuration of the breathable insert 4 in the tubular body 2, for each pair of complementary longitudinal rib 47 and groove 27 in mutual engagement, this corresponds to an inclination angle of each flank 471 or 271 of the order of 40° relative to a radial direction passing through the apex 470 and the bottom 270.

For each pair of complementary longitudinal rib 47 and groove 27 in mutual engagement, the inclination of the cooperating flanks 471 and 271 relative to the radial direction of the assembly ensures a tightening over a larger surface of the complementary features in relief 47 and 27 compared to, e.g., ribs and grooves of rectangular cross section with side walls parallel to the radial direction. For each pair of complementary longitudinal rib 47 and groove 27, the arrangement of the inclined flanks 471 and 271 in contact with each other by pairs provides not only a tightening in the radial direction of the assembly 1, but also a transversal tightening on the inclined flanks, which is substantially circumferential, as shown by the arrows $F_2$ and $F_4$ of FIG. 9 corresponding to the forces resulting from the contact between the inclined flanks. Thanks to the circumferential distribution of the longitudinal ribs 47 and grooves 27 having inclined flanks, the resulting transversal tightening on the inclined flanks is distributed over the periphery of the assembly 1. This results in a stronger anchoring of the breathable insert 4 relative to the tubular body 2 by surface interference over the entire periphery of the assembly 1. In addition, as visible in the view at larger scale of FIG. 9, the bottom 270 of each longitudinal groove 27 of the tubular body 2 has a pointed shape, whereas the apex 470 of each longitudinal rib 47 of the breathable insert 4 has a rounded shape. Thus, for each pair of complementary longitudinal rib 47 and groove 27 in mutual engagement, a gap is present between the apex 470 of the rib 47 and the bottom 270 of the groove 27. This empty space, combined with the elasticity of the constitutive polymer materials of the breathable insert 4 and the tubular body 2, allows a deformation of both the longitudinal ribs 47 of the breathable insert and the longitudinal grooves 27 of the tubular body so that the contact surface, and thus the tightening, is maximized between the breathable insert 4 and the tubular body 2. In addition, the curvature at the apex of each longitudinal rib 47 of the breathable insert 4 also improves contact between the inclined flanks 471 and 271, by avoiding a contact at a pointed end of the ribs 47 which would lead to a radial tightening force which would be less effective.

In this embodiment, the longitudinal ribs 47 on the breathable insert 4 are contiguous to one another, and the longitudinal grooves 27 on the tubular body 2 are also contiguous to one another, so that a bottom is formed between each pair of adjacent ribs 47 of the breathable insert and an apex is formed between each pair of adjacent grooves 27 of the tubular body. As shown in FIG. 9, the same configuration with a pointed shape of each bottom of the breathable insert 4 and a rounded shape of each apex of the tubular body 2 is also implemented, so that a gap is present between each pair of apex and bottom. The dimensions of the gaps between each pair of apex and bottom of the assembly may advantageously be minimized to avoid passage of dust or particles of active material from the chamber 6 toward the fillable tank 7 intended to receive the sensitive products.

Figure 4:
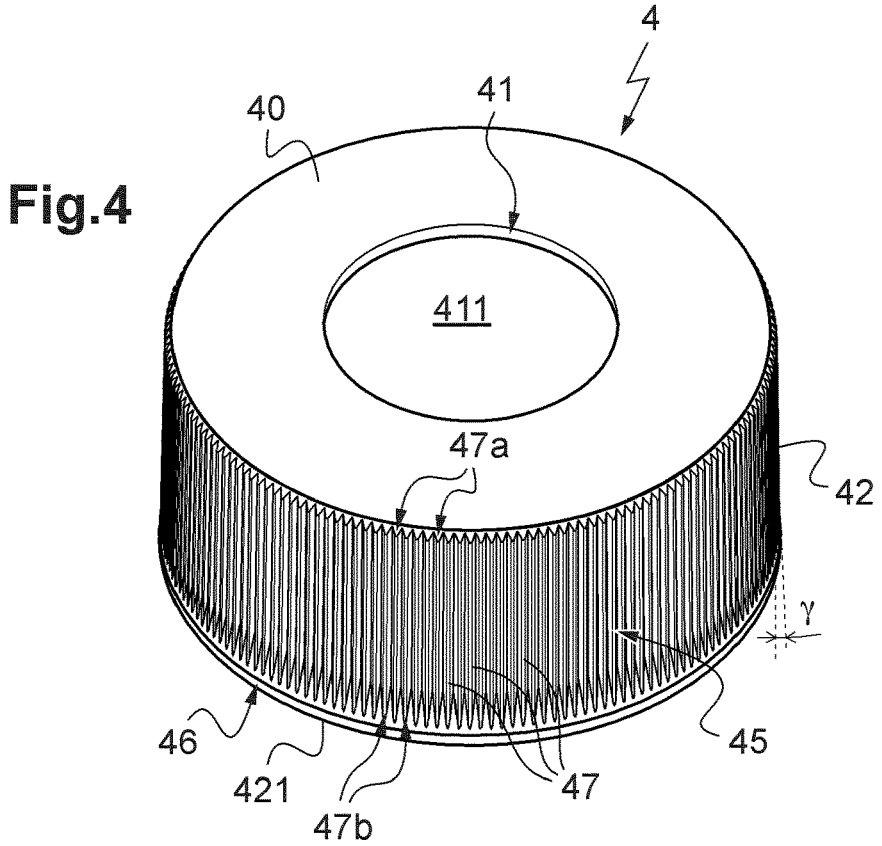
FIG. 4 is a perspective view of the breathable insert of FIG. 1.
Figure 5:
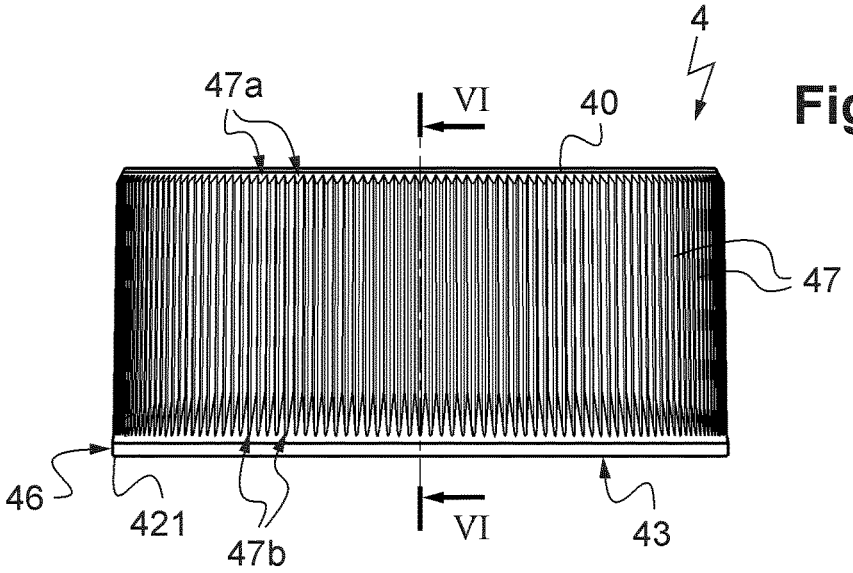
FIG. 5 is a is an elevation view of the breathable insert of FIG. 1.
Figure 6:
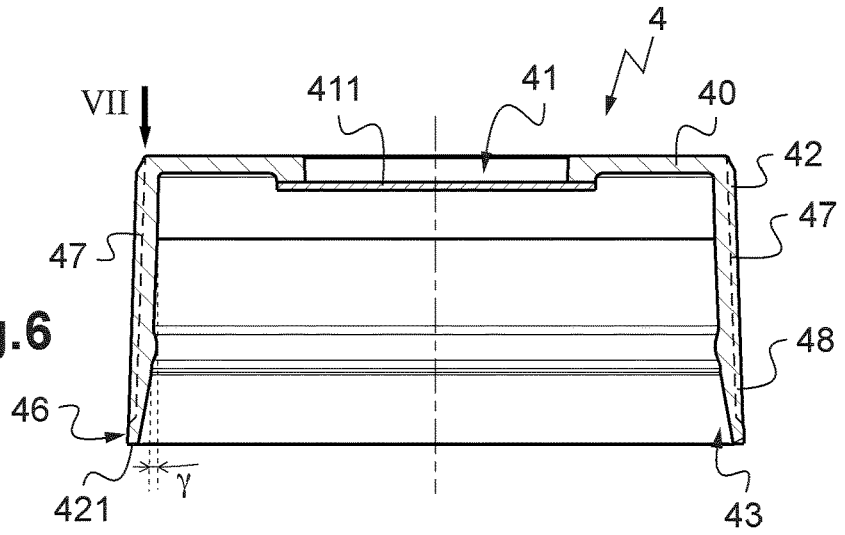
FIG. 6 is a cross section along the line VI-VI of FIG. 5.

As visible in FIGS. 4 and 5, the longitudinal ribs 47 of the breathable insert 4 are contiguous to one another and form a striated surface 45 all around the outer periphery of the breathable insert. In the same way, as visible in FIGS. 2 and 10, the longitudinal grooves 27 of the tubular body 2 are contiguous to one another and form a striated surface 25 all around the inner periphery of the tubular body. The striated surfaces 25, 45 are the complementary mechanical holding portions ensuring the attachment of the breathable insert to the tubular body by surface interference. The arrangement of the longitudinal ribs 47 and the longitudinal grooves 27 all around the periphery, together with the circular cross sections of the breathable insert 4 and the tubular body 2, ensures that the relative engagement of the ribs and grooves is easily initiated, with a self-centering effect.

Figure 7:
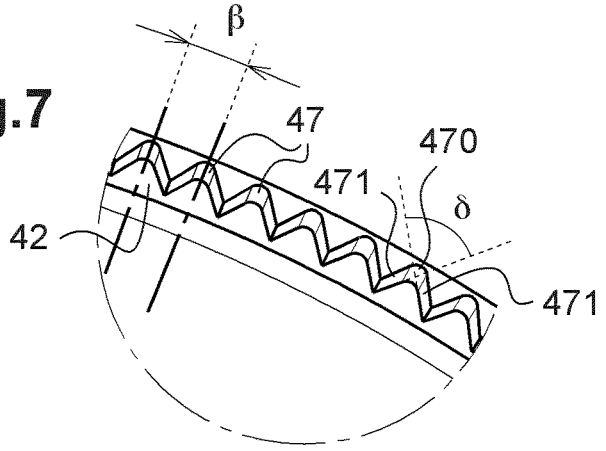
FIG. 7 is a view according to the arrow VII of FIG. 6.

As shown in FIG. 7, the successive longitudinal ribs 47 of the breathable insert 4 are distributed in the circumferential direction of the side wall 42 with an angular pitch β between two successive ribs of the order of 2°. Such a small pitch value facilitates the engagement of the longitudinal ribs 47 of the breathable insert 4 with the longitudinal grooves 27 of the tubular body 2, without having to precisely pre-align the patterns angularly. FIG. 7 also shows the two flanks 471 of each longitudinal rib 47, which are inclined relative to each other at an angle δ of the order of 80° and connected at the apex 470, with a peak-to-valley height of the order of 0.30 mm. Of course, due to their complementary shape, the longitudinal grooves 27 of the tubular body 2 also have similar values of their angular pitch, top angle and peak-to-valley height. Such geometric characteristics of the ribs 47 and grooves 27 ensure that the breathable insert 4 is properly anchored relative to the tubular body 2 by surface interference.

Additionally, to ensure a strong attachment of the breathable insert 4 relative to the tubular body 2, which may even be unremovable, the length L over which the longitudinal ribs 47 of the breathable insert 4 cooperate with the longitudinal grooves 27 of the tubular body 2 in the anchored configuration is chosen to be higher than 1/10 of the diameter of the tubular body, preferably higher than 1/6 of the diameter of the tubular body.

Each one of the tubular body 2 and the breathable insert 4 is advantageously obtained by injection molding of a thermoplastic material. High-density polyethylene (HDPE) and polypropylene are particularly suitable materials, because they provide a certain degree of rigidity to the parts, which may promote the establishment of a tightening interaction between the complementary surfaces of the ribs 47 and the grooves 27. A thermoplastic material formulated with an active material in its composition may also be used to make the tubular body 2 and/or the breathable insert 4. By way of a non-limiting example, the tubular body 2 may be made from a polypropylene thermoplastic resin; the body of the breathable insert 4 may be made from a high-density polyethylene (HDPE) thermoplastic resin; and the membrane 411 may be made from TYVEK HBD 1059B manufactured by DUPONT, a non-woven fabric comprising polyethylene fibers. The breathable insert 4 may be obtained by injection molding the body of the breathable insert 4 over the membrane 411.

The water vapor absorption rate of the breathable insert 4 was evaluated, by filling the breathable insert 4 with 3 g of a desiccant (4 Å molecular sieve), then assembling the breathable insert 4 within a tubular body. In this example, the base wall 40 of the breathable insert comprises a hole 41 having a diameter of 12.1 mm. A TYVEK membrane is sealed to the base wall 40 all around the hole 41, allowing for moisture exchange with the desiccant located in the chamber. The water vapor absorption rate was evaluated from the weight difference after 0.9 days of storage in a climatic chamber at 25° C., 40% RH. The results are given in Table 1 below.

TABLE 1

| Water vapor absorption rate (mg at 25° C., 40% RH): | |
|---|---|
| Sample | Water vapor absorption rate (mg) |
| 1 | 202.50 |
| 2 | 199.70 |
| 3 | 183.20 |

Thus, the water vapor absorption rate of the breathable insert 4 at 25° C., 40% RH is higher than 80 mg/day.

As shown in FIG. 2, upon insertion of the breathable insert 4 in the tubular body 2 with the open end 43 turned toward the transverse wall 20, the side wall 42 of the breathable insert and the lateral wall 22 of the tubular body have draft angles γ, γ' which are in reverse angular directions. More precisely, the side wall 42 of the breathable insert initially has a draft angle γ in a direction of widening away from the base wall 40, whereas the lateral wall 22 of the tubular body initially has a draft angle γ' in a direction of widening away from the transverse wall 20. Then, upon insertion of the breathable insert in the tubular body, since the open end 43 of the breathable insert is turned toward the transverse wall 20 of the tubular body, the side wall 42 of the breathable insert is at an angle with respect to the lateral wall 22 of the tubular body. As a result, the tightening of the two parts 2, 4 takes place stronger and earlier during the insertion, compared to a case where the side wall of the breathable insert and the lateral wall of the tubular body are parallel to each other. The reverse draft angles γ, γ' of the breathable insert 4 and the tubular body 2 result in faster tightening with deformation of the breathable insert and the tubular body which conform to each other. By way of example, in the embodiment shown in the figures, the draft angles γ, γ' are chosen to be substantially equal to 0.5°.

In accordance with the invention, in the anchored configuration, a continuous peripheral seal is formed between the breathable insert 4 and the tubular body 2. As clearly visible in FIG. 3, the continuous peripheral seal is established between the end surface 421 of the breathable insert and the transverse wall 20 of the tubular body, which prevents any leakage of active material 5 out of the chamber 6. In the anchored configuration, is the tubular body 2 itself which closes the open end 43 of the breathable insert, along the continuous peripheral seal, without the need for any other closing member. In the vicinity of the end surface 421 delimiting the open end 43 of the breathable insert, the side wall of the breathable insert further comprises a smooth surface portion 46 which is configured to slide in contact with the inner surface of the lateral wall 22 of the tubular body, upon insertion of the breathable insert in the tubular body. The smooth surface portion 46 is positioned, on the breathable insert, at the front of the mechanical holding portion 45 in a direction of insertion of the breathable insert in the tubular body. Thanks to its position at the front of the mechanical holding portion 45, the smooth surface portion 46 can be used as a scraper blade to push the active material or particles attached to the lateral wall of the tubular body toward the bottom part 24 of the tubular body and away from the mechanical holding portions 25, 45 of the breathable insert and the tubular body, when inserting the breathable insert in the tubular body. In this way, the smooth surface portion 46 prevents any pollution of the products 10 stored in the tank 7 in which the atmosphere is regulated.

Figure 11:
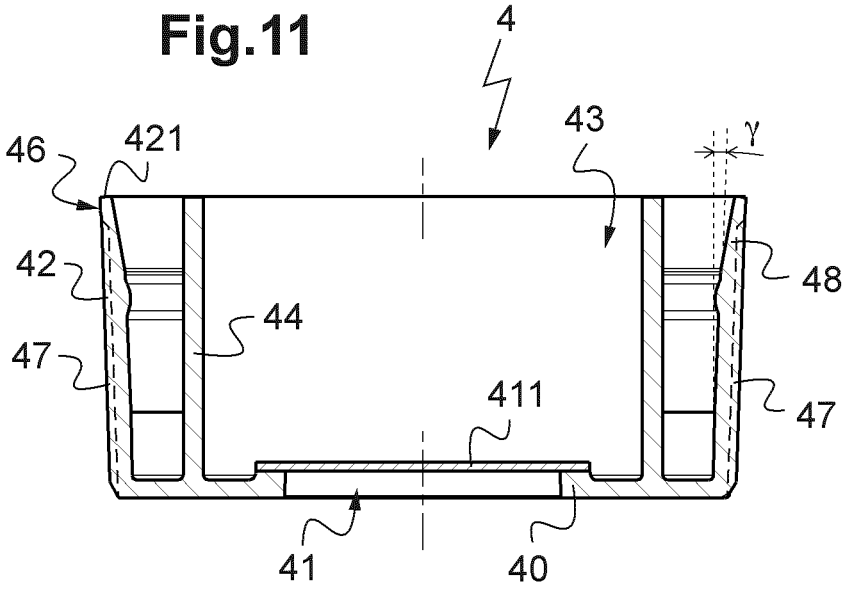
FIG. 11 is a cross section similar to FIG. 6, just rotated by 180°, of a variant of a breathable insert which may be used in an assembly according to the invention.

FIG. 11 shows a variant of a breathable insert 4 making it possible to adjust the volume of the chamber 6 for the active material 5. In this variant, the breathable insert 4 comprises an inner tubular wall 44 which defines, in the internal volume of the breathable insert delimited by the base wall 40 and the side wall 42, a sub-compartment of adjusted volume. With the breathable insert 4 of FIG. 11, it is possible to adjust the volume of the sub-compartment so that it corresponds to a desired quantity of active material 5 in the chamber 6 for a given application. In practice, the sub-compartment of adjusted volume is fully filled with the active material 5 before the breathable insert 4 is inserted in the tubular body 2. Then, in the anchored configuration, the active material 5 is closely surrounded by the walls 40, 44 of the sub-compartment and the transverse wall 20 of the tubular body and cannot move in the chamber 6, thus preventing noise from being generated which may otherwise be generated in the event of a loose distribution of the particles of the active material in the chamber. In this embodiment, the continuous peripheral seal is advantageously formed between the distal end surface of the inner tubular wall 44 and the transverse wall 20 of the tubular body, to prevent any leakage of active material out of the chamber.

Figure 10:
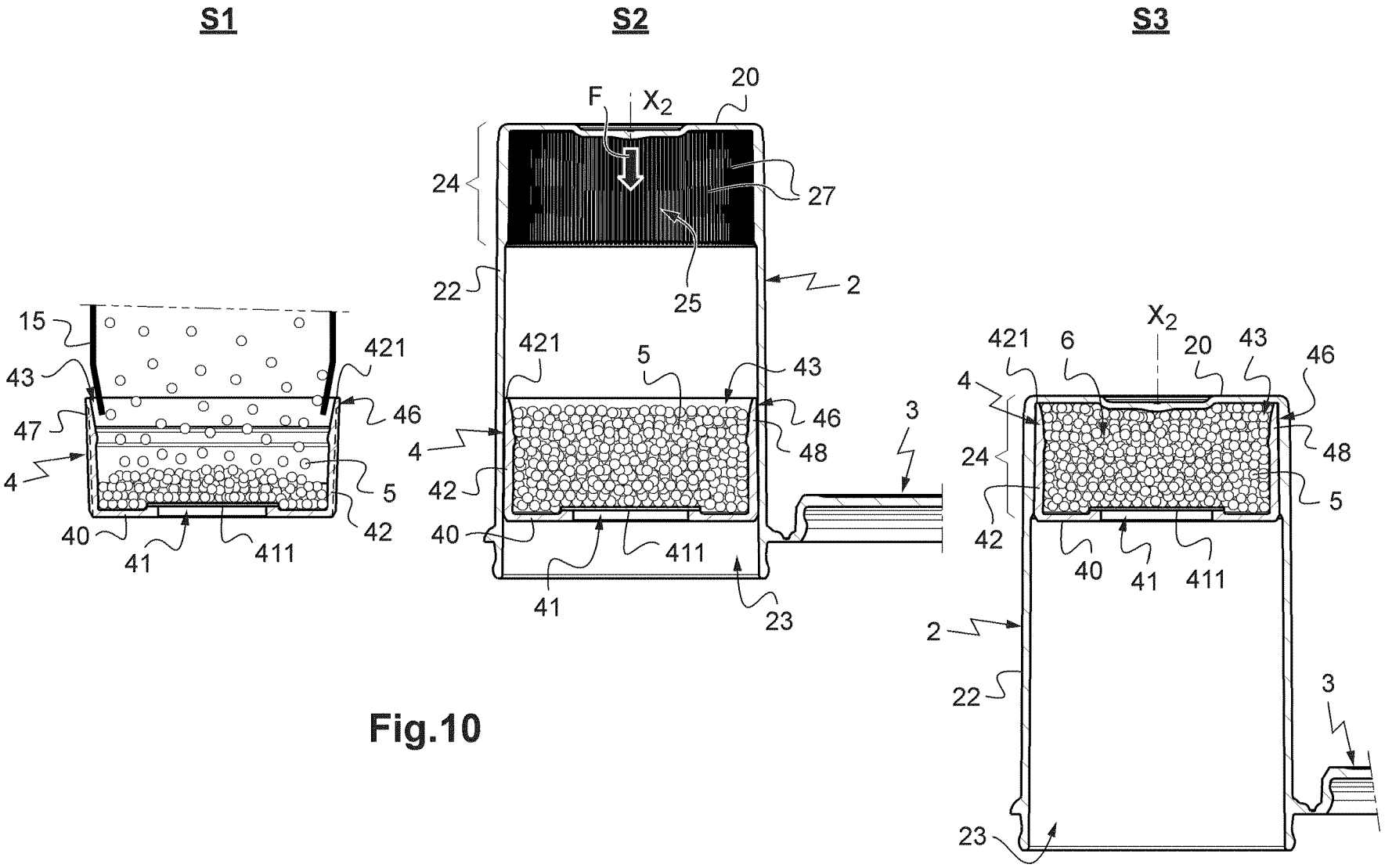
FIG. 10 is a schematic view showing successive steps S1, S2, S3 of a manufacturing method of the vial of FIG. 3.

With reference to FIG. 10, a method for manufacturing the vial 1 comprises steps as described below.

In a first step S1, the breathable insert 4, which has the shape of an open cup, is filled with an active material 5. To this end, a filling nozzle 15 may be used, to inject the particles of active material through the open end 43 into the volume of the breathable insert 4.

Then, in a step S2, the filled breathable insert 4 is inserted in the tubular body 2, with its open end 43 turned toward the transverse wall 20 of the tubular body. In practice, since the breathable insert 4 is filled with the active material 5 and the open end 43 remains open, it is the tubular body which is displaced, either by being pushed or pulled, over the breathable insert, as shown by the arrow F in step S2 of FIG. 10, while the breathable insert is preferably held stationary during its insertion in the tubular body.

As clearly visible in FIG. 10, upon insertion of the filled breathable insert 4 in the tubular body 2, the breathable insert 4 is positioned with its open end 43 facing upward, whereas the tubular body 2 is positioned with its open end 23 facing downward. Very advantageously, upon insertion of the breathable insert 4 in the tubular body 2, the smooth surface portion 46 of the breathable insert is used as a scraper blade, to push the active material 5 toward the bottom part 24 of the tubular body and away from the striated mechanical holding portions 25, 45. This ensures an optimal quality of the mechanical attachment by surface interference between the striated mechanical holding portions 25, 45.

The tubular body 2 is displaced over the breathable insert 4 until the end surface 421 of the breathable insert 4 abuts against the transverse wall 20 of the tubular body. At this stage, the anchored configuration is reached, and the striated mechanical holding portion 45 of the breathable insert is fully engaged with the corresponding striated mechanical holding portion 25 of the tubular body. In the anchored configuration as shown in step S3 of FIG. 10, a continuous seal is formed between the end surface 421 of the breathable insert and the transverse wall 20 of the tubular body, thus preventing any leakage of active material 5 out of the chamber 6.

Advantageously, this manufacturing method can be totally automated. In particular, the step S1 of filling of the breathable insert 4 with the active material using the filling nozzle 15 can be implemented automatically by a machine, and it is the same for the step S2 of displacement of the tubular body 2 along its longitudinal axis $X_2$, so that it slides around the filled breathable insert 4, which can be implemented by means of an actuator, such as a pneumatic, hydraulic or electric actuator, either pushing or pulling the tubular body. Advantageously, the tubular body 2 is directly displaced over the filled breathable insert 4, without the need for closing the open end 43 beforehand, thus allowing high production rates.

Preferably, as shown schematically in FIG. 10, the filled breathable insert 4 is held stationary during all the steps of the manufacturing method, until the anchored configuration is reached, thus limiting the risk of active material 5 falling out of the breathable insert and of wasting the active material.

Figure 12:
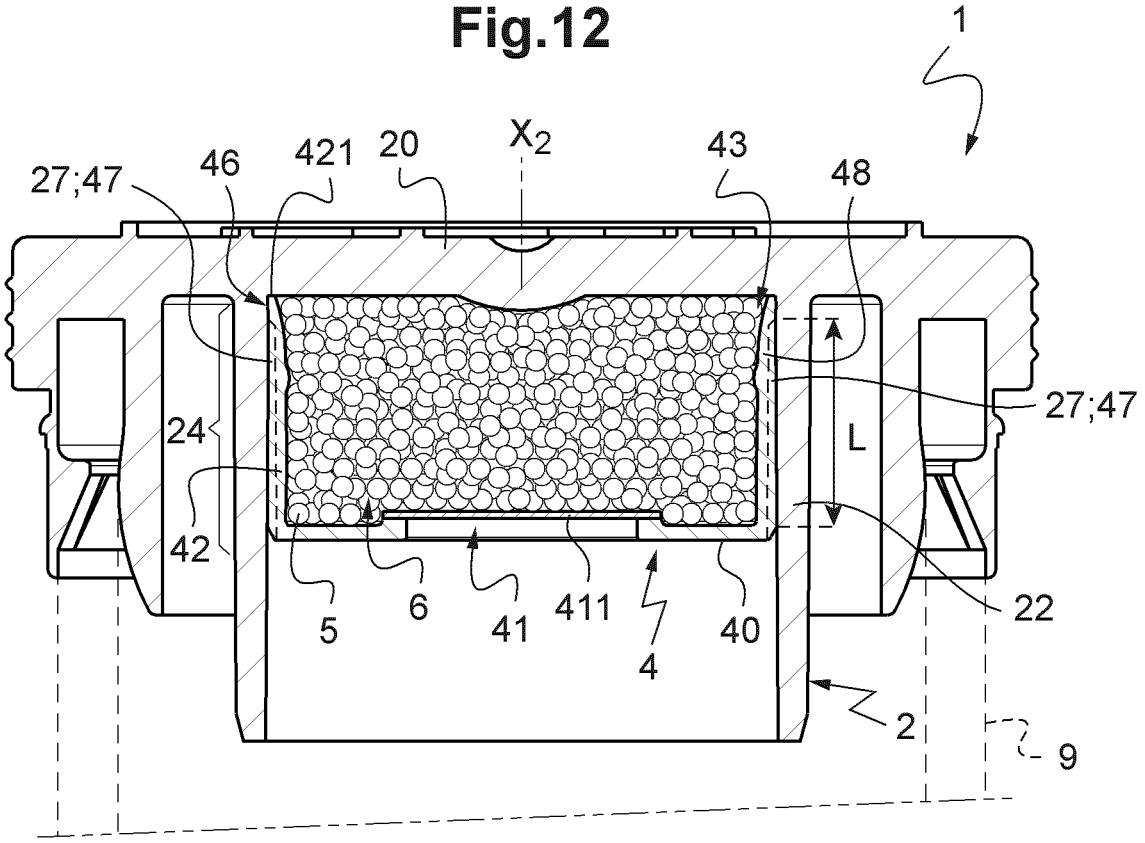
FIG. 12 is a longitudinal section of an assembly according to a second embodiment of the invention, being a stopper which comprises a tubular body and a breathable insert delimiting a chamber for an active material.

In the second embodiment shown in FIG. 12, elements that are similar to those of the first embodiment have the same references. The assembly of the second embodiment differs from the first embodiment in that it is a stopper 1 comprising the association of a tubular body 2 and a breathable insert 4 which delimit a chamber 6 for an active material 5 within the stopper 1. The stopper 1 is configured to seal a container 9 in which sensitive products are stored, and additionally regulate the atmosphere inside the container 9. Since the other features of the second embodiment are identical to those of the first embodiment, reference is made to the description of the first embodiment above for other features of the invention.

The invention is not limited to the examples described and shown. In particular, as already mentioned, the mechanical holding portions of the breathable insert and the tubular body may be smooth cylindrical surfaces, instead of longitudinally striated surfaces. In addition, several striated surfaces distinct from one another and distributed around the periphery may be provided, instead of a striated surface formed all around the periphery. In the above examples, the continuous peripheral seal, formed between the breathable insert and the tubular body in the anchored configuration, is established between an end surface of the breathable insert and the transverse wall 20 of the tubular body. However, the continuous peripheral seal may also, additionally or as a variant, be established between a portion of the side wall of the breathable insert and a portion of the lateral wall of the tubular body. In addition, the continuous peripheral seal is not necessarily established between smooth facing surfaces of the breathable insert and the tubular body. The continuous peripheral seal may for example result from the interlocking of complementary features in relief provided on the breathable insert and the tubular body, especially those of the mechanical holding portions, as long as there is a continuous contact over the entire periphery of the breathable insert and the tubular body in the anchored configuration. Of course, many other variants can be considered, falling within the scope of the appended claims.

The invention claimed is:

1. An assembly, comprising a tubular body and a breathable insert configured to be attached inside the tubular body to define a chamber for an active material in an internal volume of the tubular body, the tubular body comprising a transverse wall and a lateral wall the breathable insert comprising a base wall and a side wall having an open end on the opposite side from the base wall, wherein the chamber is delimited by a bottom part of the tubular body including the transverse wall and is closed by the breathable insert having its open end turned toward the transverse wall, wherein the side wall of the breathable insert comprises a mechanical holding portion configured to cooperate by surface interference with a corresponding mechanical holding portion of the lateral wall of the tubular body, wherein the breathable insert is anchored relative to the tubular body by surface interference resulting from mutual engagement of the mechanical holding portions, wherein, in an anchored configuration, the side wall of the breathable insert and the lateral wall of the tubular body cooperate by cylinder-in-cylinder friction without undercut, and a continuous peripheral seal is formed between the breathable insert and the tubular body.

2. The assembly according to claim 1, wherein the mechanical holding portion of the side wall of the breathable insert is formed by a smooth cylindrical surface configured to cooperate by surface interference with a complementary smooth surface forming the mechanical holding portion of the lateral wall of the tubular body.

3. The assembly according to claim 1, wherein the mechanical holding portion of the side wall of the breathable insert is formed by a longitudinally striated surface configured to cooperate by surface interference with a complementary longitudinally striated surface forming the mechanical holding portion provided on the lateral wall of the tubular body substantially parallel to a longitudinal axis thereof ($X_2$).

4. The assembly according to claim 3, wherein the mechanical holding portion of the side wall the breathable insert comprises a plurality of longitudinal features in relief configured to cooperate by mutual engagement with complementary longitudinal features in relief provided on the mechanical holding portion of the peripheral wall of the tubular body substantially parallel to a longitudinal axis ($X_2$) thereof.

5. The assembly according to claim 4, wherein at least one longitudinal feature in relief of one among the breathable insert and the tubular body has two flanks inclined with respect to a radial direction of the breathable insert or tubular body passing through the feature in relief, wherein, in the anchored configuration, both inclined flanks of the at least one longitudinal feature in relief of the one among the breathable insert and the tubular body are in contact with a complementary longitudinal feature in relief of the other one among the breathable insert and the tubular body.

6. The assembly according to claim 1, wherein, in the anchored configuration, the open end of the breathable insert is closed by the continuous peripheral seal formed between the breathable insert and the tubular body without any other closing member.

7. The assembly according to claim 1, wherein a water vapor absorption rate of the breathable insert is higher than or equal to 80 mg/day at 25° C., 40% RH.

8. The assembly according to claim 1, wherein the base wall of the breathable insert comprises a gas-permeable portion configured to prevent passage of the active material from the chamber to an outside of the chamber.

9. The assembly according to claim 1, wherein, in the anchored configuration, the continuous peripheral seal is formed between an end surface of the breathable insert and the transverse wall of the tubular body.

10. The assembly according to claim 1, wherein, in the anchored configuration, the continuous peripheral seal is formed between the side wall of the breathable insert and the lateral wall of the tubular body.

11. The assembly according to claim 1, wherein the side wall of the breathable insert further comprises a smooth surface portion configured to slide in contact with an inner surface of the lateral wall of the tubular body upon insertion of the breathable insert in the tubular body, the smooth surface portion being positioned, on the breathable insert, at the front of the mechanical holding portion in a direction of insertion of the breathable insert in the tubular body.

12. The assembly according to claim 1, wherein, upon insertion of the breathable insert in the tubular body, with the open end of the breathable insert turned toward the transverse wall of the tubular body, the side wall of the breathable insert and the lateral wall of the tubular body have draft angles (Y, Y') in reverse angular directions.

13. The assembly according to claim 1, wherein, upon insertion of the breathable insert in the tubular body, deformations of the breathable insert and the tubular body are kept within an elastic deformation range.

14. The assembly according to claim 1, wherein a thickness of the side wall of the breathable insert is reduced in a distal region in a vicinity of the smooth surface portion.

15. The assembly according to claim 1, wherein the breathable insert comprises an inner tubular wall defining, in an internal volume of the breathable insert delimited by the base wall and the side wall, a sub-compartment of adjusted volume.

16. The assembly according to claim 1, wherein a body of the breathable insert is made of a polymer-based material including an active material.

17. A method for manufacturing an assembly comprising a tubular body and a breathable insert configured to be attached inside the tubular body so as to define a chamber for an active material in an internal volume of the tubular body, the tubular body comprising a transverse wall and a lateral wall, the breathable insert comprising a base wall and a side wall having an open end on an opposite side from the base wall, the chamber being delimited by a bottom part of the tubular body including the transverse wall and being closed by the breathable insert having its open end turned toward the transverse wall, the side wall of the breathable insert comprising a mechanical holding portion configured to cooperate by surface interference with a corresponding mechanical holding portion of the lateral wall of the tubular body, wherein the method comprises steps of:

filling at least part of an internal volume of the breathable insert with an active material;

inserting the filled breathable insert in the tubular body, with its open end turned toward the transverse wall of the tubular body, until the breathable insert is anchored relative to the tubular body by surface interference resulting from mutual engagement of the mechanical holding portions, wherein, in an anchored configuration, the sidewall of the breathable insert and lateral wall of the tubular body cooperate by cylinder-in-cylinder friction without undercut, and a continuous peripheral seal is formed between the breathable insert and the tubular body.

18. The method according to claim 17, wherein the mechanical holding portion of the side wall of the breathable insert comprises a plurality of longitudinal features in relief configured to cooperate by mutual engagement with complementary longitudinal features in relief provided on the mechanical holding portion of the lateral wall of the tubular body substantially parallel to a longitudinal axis ($X_2$) thereof.

19. The method according to claim 17, wherein the open end of the breathable insert remains open after the breathable insert has been filled with the active material and the filled breathable insert is inserted in the tubular body with its open end still open, wherein, upon insertion of the filled breathable insert in the tubular body, the breathable insert is positioned with its open end facing upward while the tubular body is positioned with its open end facing downward.

20. The method according to claim 17, wherein, upon insertion of the filled breathable insert in the tubular body, the breathable insert is held stationary while the tubular body is displaced over the breathable insert.

21. The method according to claim 17, wherein the filled breathable insert is inserted in the tubular body until it abuts against the transverse wall of the tubular body.

* * * * *